US008668017B2

(12) United States Patent
Cuiper et al.

(10) Patent No.: US 8,668,017 B2
(45) Date of Patent: Mar. 11, 2014

(54) VARIABLE BUOYANCY SUBSEA RUNNING TOOL

(75) Inventors: Glen H. Cuiper, Spring, TX (US); Paulo Cezar Silva Paulo, Katy, TX (US)

(73) Assignee: Aker Solutions Inc., Houston, TX (US)

( * ) Notice: Subject to any disclaimer, the term of this patent is extended or adjusted under 35 U.S.C. 154(b) by 0 days.

(21) Appl. No.: 13/556,954

(22) Filed: Jul. 24, 2012

(65) Prior Publication Data

US 2012/0292038 A1 Nov. 22, 2012

Related U.S. Application Data

(63) Continuation of application No. 12/497,250, filed on Jul. 2, 2009, now Pat. No. 8,235,124.

(60) Provisional application No. 61/077,643, filed on Jul. 2, 2008.

(51) Int. Cl.
*E21B 7/12* (2006.01)

(52) U.S. Cl.
USPC ..... 166/338; 166/339; 166/343; 166/341

(58) Field of Classification Search
USPC ..... 166/338, 339, 343, 341, 345, 360, 365, 166/368
See application file for complete search history.

(56) References Cited

U.S. PATENT DOCUMENTS

| | | | | | |
|---|---|---|---|---|---|
| 3,954,137 | A * | 5/1976 | Baugh | 166/351 |
| 4,154,552 | A * | 5/1979 | VAN Bilderbeek | 405/229 |
| 4,281,716 | A * | 8/1981 | Hall | 166/339 |
| 4,626,136 | A * | 12/1986 | Gunderson | 405/224 |
| 4,657,439 | A | 4/1987 | Petersen | |
| 4,702,321 | A | 10/1987 | Horton | |
| 4,730,677 | A * | 3/1988 | Pearce et al. | 166/345 |
| 4,848,472 | A * | 7/1989 | Hopper | 166/344 |
| 5,107,931 | A | 4/1992 | Valka et al. | |
| 6,227,301 | B1 | 5/2001 | Edwards et al. | |
| 6,386,290 | B1 * | 5/2002 | Headworth | 166/346 |
| 6,808,021 | B2 | 10/2004 | Zimmerman et al. | |
| 6,834,724 | B2 * | 12/2004 | Headworth | 166/384 |
| 7,086,807 | B2 * | 8/2006 | Mackinnon | 405/170 |
| 2002/0074135 | A1 * | 6/2002 | Headworth | 166/384 |
| 2002/0079108 | A1 * | 6/2002 | Headworth | 166/384 |
| 2003/0044240 | A1 * | 3/2003 | Bergeron | 405/224 |
| 2003/0180097 | A1 | 9/2003 | Fitzgerald et al. | |
| 2006/0056918 | A1 * | 3/2006 | Luppi | 405/169 |
| 2006/0225810 | A1 * | 10/2006 | Baylot et al. | 141/98 |
| 2007/0044972 | A1 * | 3/2007 | Roveri et al. | 166/367 |
| 2007/0231072 | A1 * | 10/2007 | Jennings et al. | 405/75 |
| 2008/0105432 | A1 * | 5/2008 | Zemlak et al. | 166/336 |
| 2008/0135232 | A1 * | 6/2008 | Lawler et al. | 166/173 |
| 2008/0264643 | A1 * | 10/2008 | Skeels et al. | 166/348 |
| 2008/0302535 | A1 * | 12/2008 | Barnes | 166/339 |
| 2009/0191001 | A1 * | 7/2009 | Headworth | 405/202 |

* cited by examiner

*Primary Examiner* — Matthew Buck
*Assistant Examiner* — Aaron Lembo
(74) *Attorney, Agent, or Firm* — Parsons Behle & Latimer

(57) ABSTRACT

A variable buoyancy subsea running tool for use with subsea transportable devices, such as a tree cap. The buoyancy of the running tool may be varied through fluid or gas displacement in one or more containers. Alternatively, the running tool may be configured with a buoy that has static buoyancy, with the buoyancy of the running tool being varied through the addition of a counterweight. The running tool can be used to install or uninstall a tree cap on a subsea tree. Installation of a tree cap may be actuated by a remotely operated vehicle. Additionally, the running tool may be moved by a remotely operated vehicle and may have additional features such as a position locator device.

2 Claims, 3 Drawing Sheets

VARIABLE BUOYANCY SUBSEA RUNNING TOOL

CROSS REFERENCE TO RELATED APPLICATIONS

This application is a continuation of U.S. patent application Ser. No. 12/497,250 filed Jul. 2, 2009, now U.S. Pat. No. 8,235,124 and entitled "Variable Buoyancy Subsea Running Tool" which claims benefit from U.S. Provisional Patent Application No. 61/077,643, filed on Jul. 2, 2008, the disclosures of which are hereby incorporated by reference in their entirety.

BACKGROUND OF THE INVENTION

1. Field of the Invention

The present disclosure generally relates to a variable buoyancy subsea running tool used to run a subsea transportable device, such as an internal tree cap, to a subsea tree. Typically, a subsea running tool can be manipulated using a remotely operated vehicle ("ROV").

2. Description of the Related Art

A wellhead assembly, such as that employed on the seabed for offshore drilling and production operations may often include a "conventional" or "vertical" subsea tree used to access the well bore. The subsea tree includes a bore that may be sealed off or isolated using a subsea transportable device such as a tree cap. An ROV and a subsea running tool are sometimes used to facilitate the installation of the tree cap.

Horizontal subsea "Christmas" tree systems are often completed with an internal tree cap as a secondary barrier. Due to the nature of this operation and its related high cost, the internal tree cap has been a challenging and costly completion activity. There is a need to solve installation problems of an internal tree cap that make it risky and less profitable.

An ROV may be used to install and retrieve the tree cap in open water. But, since an internal tree cap with pressure barrier capability is very heavy with respect to the submerged weight of an ROV designed to transport the internal tree cap the heavy submerged weight may cause poor handling and maneuverability with the ROV. Installing floaters on the tree cap to offset its submerged weight may possibly help with the ROVs diminished handling and maneuverability. However, the tree cap does not provide much space on which to install floaters. One potential solution to this problem is mounting floaters on the running tool used to transport and install the internal tree cap. While this added buoyancy helps in the transport of the tree cap to the subsea tree, once the tree cap is deployed the floaters added to the running tool present a potential problem. With the running tool free from the extra weight of the tree cap, the buoyant effect of the floaters may lift the running tool to the surface without substantial control causing a potentially dangerous situation.

The present invention is directed to overcoming, or at least reducing the effects of, one or more of the issues set forth above.

SUMMARY OF THE INVENTION

The object of the present disclosure is to provide a subsea running tool with variable buoyancy to facilitate the installation and removal a subsea transportable device on a subsea tree. More specifically, a variable buoyancy running tool is provided for the installation and removal of an internal tree cap used in a subsea tree.

In one embodiment, the subsea running tool includes a body member with a first connection mechanism that is adapted to selectively connect a subsea transportable device to the body member. The subsea transportable device may be an internal tree cap. The running tool also includes a variable buoyancy system such as a flotation device and a counterweight. The flotation device is connected to the body member and provides buoyancy to the running tool. The running tool also has a counterweight connection mechanism that is adapted to selectively connect the counterweight to the body.

The first connection mechanism may be adapted to secure an internal tree cap. The running tool can transport the secured internal tree cap to a subsea tree for installation. When landed on the subsea tree, a counterweight may be connected to the running tool using a rotatable shaft holder with a tab. The counterweight may be connected after the subsea transportable device is disconnected from the running tool. Additionally, the submerged weight of the counterweight may be substantially equal to the submerged weight of the subsea transportable device. The variable buoyancy running tool may include a location signaling device that provides location information to an operator, such as a GPS type device.

Another embodiment of a variable buoyancy subsea running tool is one that includes a variable buoyancy system comprising a container that has an enclosed volume of a gas. In this variable buoyancy system, the volume of gas may be dynamically reduced or increased to change the buoyancy of the running tool while moving through open water or while landed on a subsea tree. A container may be, for example, one or more sea chest cylinders. The running tool may include a first connection mechanism that is adapted to selectively secure a subsea transportable device, such as a subsea tree cap. The running tool may be used to install the subsea transportable device in a tree spool. Upon installation of the subsea transportable device, the displacement of the container may be changed to compensate for releasing the internal tree cap from the running tool.

A method of using a variable buoyancy subsea running tool to deploy a subsea transportable device includes moving a running tool assembly to a subsea tree. The running tool assembly may be comprised of a running tool selectively connected to a subsea transportable device, which may be an internal tree cap. The method includes landing the running tool assembly on a subsea tree and releasing the subsea transportable device from the running tool assembly. The method further includes varying the buoyancy of the running tool. The buoyancy of the running tool may be varied by connecting the running tool to a static mass. Alternatively, the buoyancy of the running tool may be varied by changing the amount of fluid displaced by a container attached to the running tool.

A method of using a variable buoyancy subsea running tool to retrieve a subsea transportable device includes moving a running tool to a subsea tree with a subsea transportable device installed in or on the subsea tree. The method further includes landing the running tool on the subsea tree and selectively connecting the running tool to the subsea transportable device. The running tool may then be used to uninstall the subsea transportable device, which may be an internal tree cap, from the subsea tree. Further, the buoyancy of the running tool may be varied to increase the flotation of the running tool to offset the submerged weight of the subsea transportable device.

Figure 2:
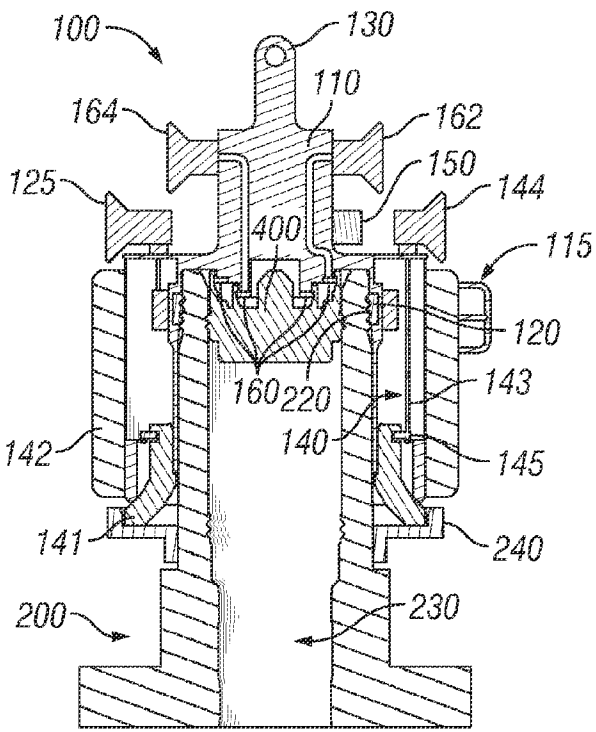
FIG. 2 is a cross-section view of the embodiment of FIG. 1 of the variable buoyancy running tool lowered onto the subsea tree and connected to the subsea transportable device.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of a variable buoyancy subsea running tool are described below as they might be employed in installing or removing equipment such as a tree cap on a subsea tree. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects, advantages, and uses of the various embodiments of the invention will become apparent from consideration of the following description and drawings.

Figure 1:
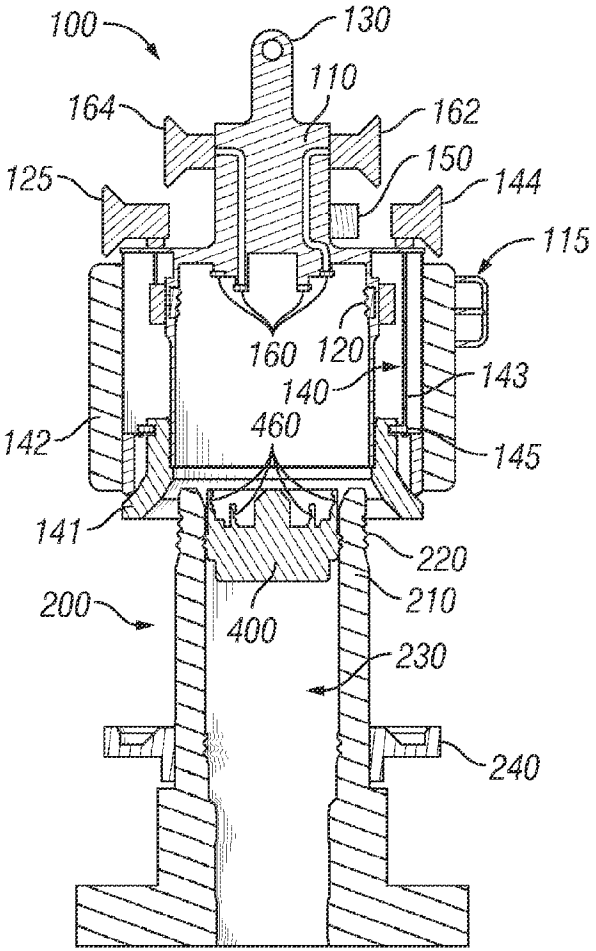
FIG. 1 is a cross-section view of an embodiment of a variable buoyancy running tool that is above a subsea tree with a subsea transportable device installed.

FIG. 1 is a cross-sectional view of an embodiment of a variable buoyancy subsea running tool ("running tool") 100 that comprises a body 110 with an optimal lifting point 130, a temporary latch mechanism 120, a position signaling device 150, a transportable device connecting mechanism 160, and a variable buoyancy system that will be discussed later in the disclosure. The running tool has been landed on a subsea tree 200 comprising a spool body 210, an outer latch profile 220, a bore 230, and a support member ("ledge") 240, such as a protrusion, ledge, hanger, or other suitable weight bearing support member.

In the embodiment shown in FIG. 1, the variable buoyancy system comprises a flotation device 142, such as a buoy, and a counterweight connection mechanism that is adapted to selectively connect a counterweight 141 to the body 110 of the running tool 100. The counterweight connection mechanism 140 comprises a shaft handle 144, shaft 143, and shaft tab 145.

The flotation device 142 may be affixed to the running tool 100 and, in some embodiments, the flotation device 142 may be made of a material that resists compression, such as, for example, syntactic foam. The flotation device 142 is designed to add buoyancy to the running tool 100, making it easier for the ROV 300 to maneuver the running tool 100 in open water. The flotation device 142 may be adapted to offset the combined submerged weight of the running tool 100 and counterweight 141 or subsea transportable device 400, making the running tool 100 substantially neutrally buoyant. Neutral buoyancy is a condition in which a physical body's mass is about equal to the mass it displaces in a surrounding medium.

Alternatively, the flotation device 142 may be adapted to offset any suitable amount of submerged weight that allows the ROV 300 to move the running tool 100 without overstressing the ROV 300. For example, the flotation device 142 may offset 10%, 20%, 50%, 75%, 100%, 110%, 120%, or another suitable percentage of the combined submerged weight of the running tool 100 and the counterweight 141, as would be apparent to one of ordinary skill in the art given the benefit of this disclosure.

The counterweight connection mechanism 140 can selectively secure the counterweight 141 to the running tool 100. For example, when selectively securing the counterweight 141 to the running tool 100, the shaft handle 144 may be acted upon by the ROV 300 to create a rotation in the shaft 143 and, accordingly the shaft tab 145, such that the shaft tab 145 is positioned in a recessed region of the counterweight 141. In this configuration the shaft tab 145 can support the counterweight 141, connecting the counterweight to the running tool 100. Other mechanical systems, such as a locking profile, may be used to selectively connect a counterweight to a running tool, as would be apparent to one of ordinary skill in the art, given the benefit of this disclosure.

The running tool 100 further comprises a transportable device connecting mechanism 160, which can selectively connect to a subsea transportable device 400, such as a tree cap. The transportable device connecting mechanism 160 may secure the subsea transportable device 400 to the running tool 100 for transport through open water. The transportable device connecting mechanism 160 may comprise a securing profile or one or more protrusions that can engage one or more locking profiles 460 on the subsea transportable device 400. Other known mechanisms may be used to connect a subsea transportable device 400 to the running tool 100, as would be apparent to one of ordinary skill in the art given the benefit of this disclosure.

The running tool 100 may further comprise a position signaling device 150, such as a GPS or other radio device, which sends data to a receiver indicating the position of the running tool 100. This may be used for tasks such as locating the running tool 100 in case of malfunction and re-affirming the position of the subsea tree 200. Other systems that indicate the position of the running tool 100 may be used, as would be apparent to one of ordinary skill in the art having the benefit of this disclosure.

In many cases, an ROV 300 (illustrated in FIG. 5) may be used to move the running tool 100 through open water. The ROV 300 may connect to the running tool 110 through an arm 310. The arm 310 may have a hand 315 that is adapted to connect to the running tool at an ROV connecting point 115.

FIG. 2 illustrates the running tool 100 installed on the subsea tree 200. As shown, the running tool 100 has been lowered onto the spool body 210 and has been selectively secure in place by the temporary latch mechanism 120, which is connected to the outer latch profile of the subsea tree 200. The temporary latch mechanism 120 may be actuated by the ROV 300 through a latch port 125.

FIG. 2 further shows the transportable device connecting mechanism 160 interfacing with a subsea transportable device 400. Actuation ports 162 and/or 164 may be used by the ROV 300 to actuate the transportable device connecting mechanism 160, which can secure the subsea transportable device 400 to the running tool 100. In some embodiments port 162 will actuate a portion of the mechanism 160, while port 164 will actuate another portion of the mechanism 160.

Further shown in FIG. 2 is a ledge 240 that is connected to the outside of the spool body 210. As shown, the counterweight 141 may rest upon the ledge 240 while the running tool 100 is installed on the subsea tree 200. In some embodiments, the counterweight 141 can be substantially the same weight as the subsea transportable device 400. Alternatively, the counterweight may be another suitable weight. When the subsea transportable device 400 is connected to the running tool 100 the counterweight 141 is disconnected from the running tool 100, and may continue to rest on the ledge 240 indefinitely.

Figure 3:
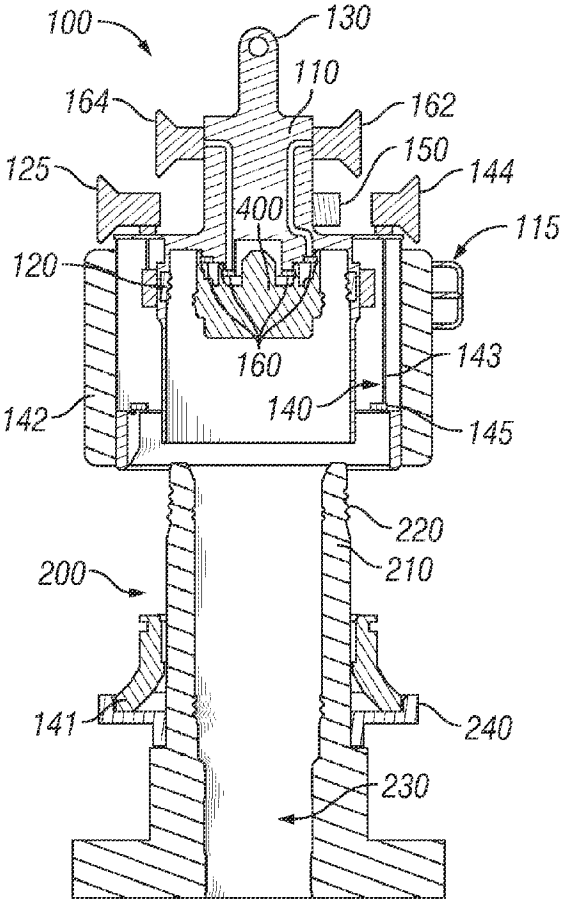
FIG. 3 is a cross-section view of the embodiment of FIG. 1 of the variable buoyancy running tool, connected to the subsea transportable device, and above the subsea tree.

FIG. 3 shows the running tool 100 in a raised position from the spool body 210, similarly to FIG. 1. The subsea transportable device 400 has been uninstalled and is secured to the running tool 100 with the connecting mechanism 160. Additionally, the counterweight 141 has been released from the running tool 100 and is resting on the ledge 240.

In this position, the running tool may be moved through open water by an ROV 300. With the counterweight 141 removed, the submerged weight of the device 400 and the running tool 100 may be substantially equal.

Because the weight of the running tool 100 and the device 400 remains within operating parameters of a maneuvering device, such as an ROV 300, the running tool 100 will be able to be handled in a similar fashion as when it was delivered to the subsea tree 200. Operating a maneuvering device within operating parameters may reduce uncontrolled maneuvers. Additionally, if the running tool 100 remains substantially neutrally buoyant, as in the case where buoy 142 substantially offsets the full submerged weight of the running tool 100 and the counterweight 141 or the device 400, the running tool 100 may be maneuvered by a smaller or less powerful ROV 300 than would be required for moving a non-offset running tool 100 and counterweight 141 through open water.

A typical subsea transportable device 400 retrieval sequence may start with a running tool 100 and device 400 assembly being landed onto the subsea tree 200 by an ROV 300, as shown in FIG. 2. The ROV 300 may then actuate the latch port 125 to selectively connect to the outer latch profile 220 of the subsea tree 200 with temporary latch mechanism 120. The ROV 300 may then actuate the connecting mechanism 160 through port 162 and/or 164. While secured to the subsea tree 200, the running tool 100 may uninstall the subsea transportable device 400.

While the running tool 100 is selectively connected to the subsea tree 200, the variable buoyancy system may be changed to compensate for the change in weight due to the retrieval of the subsea transportable equipment 400. For example, the shaft 143 may be rotated, removing the tab 145 from a recess in the counterweight 141, thereby releasing the counterweight 141 onto the ledge 240. Alternatively, some other embodiments may vary the displaced volume in an attached sea chest cylinder 171, as will be explained later in the disclosure.

When the running tool 100 has finished uninstalling the subsea transportable device 400, the temporary latch mechanism 120 may be unlatched from the outer latch profile 220 of the subsea tree 200. When no longer engaged to the subsea tree 200, the running tool 100 may be raised and moved away from the subsea tree 200 by the ROV 300.

FIGS. 1, 2, and 3 are illustrations of a sequence of actions that might be made by the running tool 100 before, during and after the retrieval of a subsea transportable device 400, such as a tree cap. It will be appreciated that the actions could be reversed to show the running tool 100 before, during, and after the installation of a subsea transportable device such as a tree cap 400.

Figure 4:
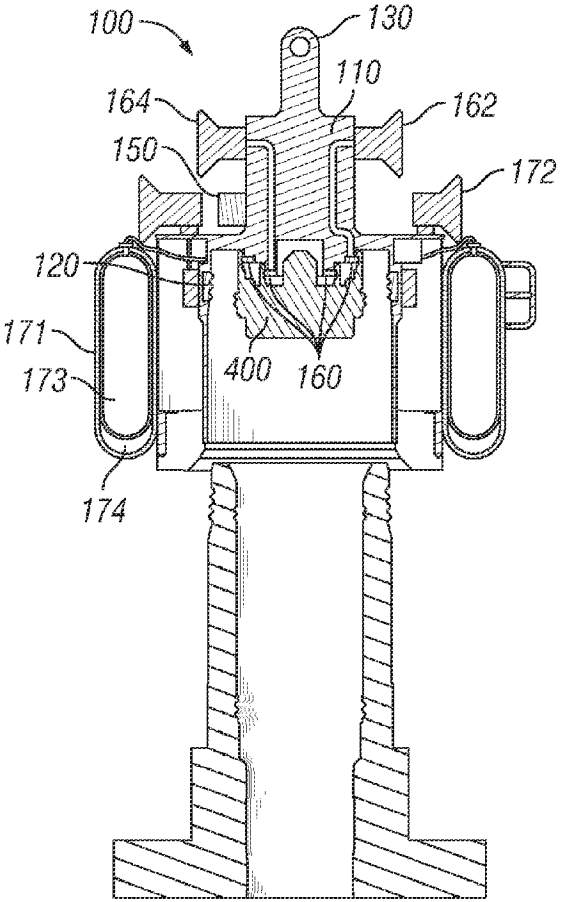
FIG. 4 is a cross-section view of another embodiment of a variable buoyancy running tool, above a subsea tree, and connected to a subsea transportable device.

FIG. 4 is a cross-section view of another embodiment of a running tool 100 comprising a body member 110, an optimal lifting point 130, a temporary latch mechanism 120, a position signaling device 150, and another embodiment of a variable buoyancy system, as will be discussed later in the disclosure. As shown in FIG. 4, the running tool 100 is selectively connected to a subsea transportable device 400 and is positioned over a subsea tree 200. The subsea tree 200 comprises a spool body 210, a bore 230, and an outer latch profile 220. In many cases, an ROV 300 (shown in FIG. 5) may be used to move the running tool 100 through open water.

In the embodiment shown in FIG. 4, the variable buoyancy system comprises an actuation port 172, such as a hot stab interface, and one or more sea chest cylinders 171. As used in this disclosure, a sea chest cylinder 171 is any container that includes an internal cavity that may be filled with a gas 173. The sea chest cylinders 171 include a mechanism to vary displacement, such as by increasing or decreasing a volume of gas 173 within the cylinders 171. When a volume of gas 173 with the cylinders 171 is changed, a corresponding volume of liquid 174 within the cylinders 171 may be displaced. Alternative mechanisms for varying displacement may be used, as would be apparent to those of ordinary skill in the art, given the benefit of this disclosure.

Varying the amount of liquid 174 displaced by the cylinders 171 can be used to dynamically vary the submerged buoyancy of the running tool 100, as a whole. In some embodiments, the sea chest cylinders 171 may have a gas pre-charge (e.g., nitrogen pre-charge) that provides the running tool 100 with an initial buoyancy force. The buoyancy may be varied by the injection fluid 174, such as hydraulic fluid or sea water, into the sea chest cylinders 171 and/or by releasing gas 173 from the cylinders 171. Variation of the displacement in the sea chest cylinder 171 may be actuated by the ROV 300, such as through the actuation port 172.

Referring again to FIG. 4, the varied buoyancy may be used to offset the submerged weight of the running tool 100 as the submerged weight increases or decreases due to attaching to or releasing additional mass, such as the subsea transportable device 400.

In operation, the subsea transportable device 400 may be connected to or released from the running tool 100, which changes the submerged weight of the running tool 100. The buoyancy of the sea chest cylinder 171 can be varied to offset the change in submerged weight. This buoyancy variation may reduce the submerged weight of the running tool 100 enough to allow the running tool 100 to be moved through open water without substantially overstressing the ROV 300, as previously discussed.

Figure 5:
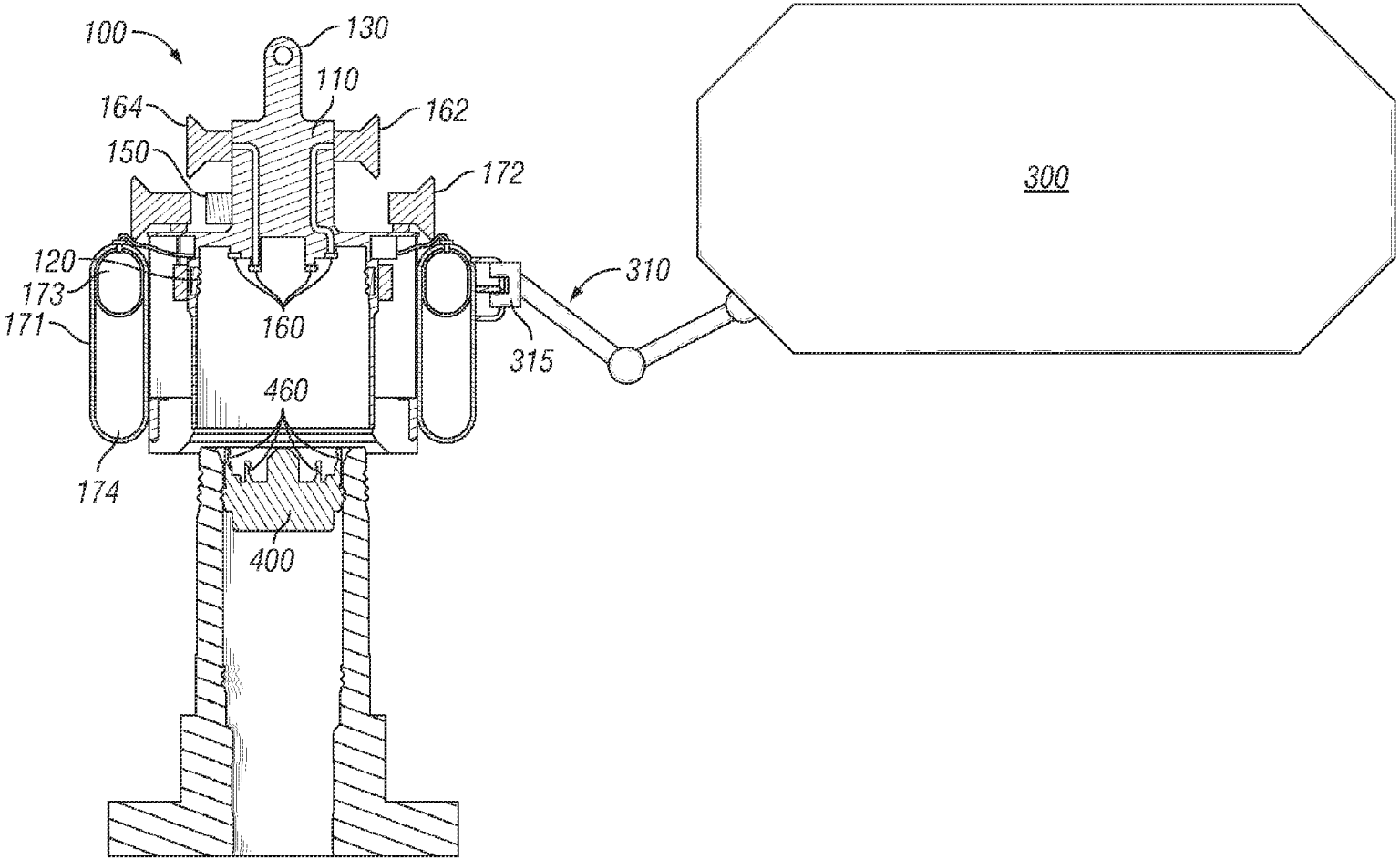
FIG. 5 shows the embodiment of FIG. 4, the variable buoyancy running tool is being manipulated by a remotely operated vehicle, above a tree spool, with the subsea transportable device installed on the tree spool.

FIG. 5 shows a running tool 100 as it might be manipulated by an ROV 300 in open water. The running tool 100 is selectively connected to a tree cap 400 and the running tool 100 is positioned over a subsea tree 200. The ROV 300 is shown with an arm 310 having a hand 315 that may connect to the running tool 100 at a connecting point 115. From this position, the running tool 100 may be moved away from the subsea tree 200 or installed on the subsea tree 200. While moving through open water with the tree cap 400, the variable buoyancy system of the running tool 100 may be in a configuration such that the tree cap 400 and running tool 100, in combination, are substantially neutrally buoyant. This may enable the ROV 300 to more easily manipulate the running tool 100 with the tree cap 400.

Although various embodiments have been shown and described, the invention is not so limited and will be understood to include all such modifications and variations as would be apparent to one of ordinary skill in the art.

What is claimed is:

1. A method of using a variable buoyancy subsea running tool to deploy a subsea transportable device, the method comprising:

moving a running tool assembly to a subsea tree, the running tool assembly comprising a running tool having a variable buoyancy system and a subsea transportable device;

landing the running tool assembly on the subsea tree;

releasing the subsea transportable device from the running tool assembly;

varying the buoyancy of the running tool to compensate for releasing the subsea transportable device, wherein varying the buoyancy of the running tool comprises connecting a counterweight using a rotatable shaft and tab.

2. A method of using a variable buoyancy subsea running tool to retrieve a subsea transportable device, the method comprising:

moving a running tool to a subsea tree, the running tool comprising a variable buoyancy system;

landing the running tool on the subsea tree;

connecting a subsea transportable device to the running tool;

varying the buoyancy of the running tool to compensate for connecting the subsea transportable device, wherein varying the buoyancy of the running tool comprises rotating a shaft, removing a tab from a recess in a counterweight, and releasing the counterweight from the running tool.

* * * * *